US011394123B2

(12) United States Patent
Liu et al.

(10) Patent No.: US 11,394,123 B2
(45) Date of Patent: Jul. 19, 2022

(54) MICROSTRIP COLLINEAR ARRAY

(71) Applicant: ACCTON TECHNOLOGY CORPORATION, Hsinchu (TW)

(72) Inventors: I-Ru Liu, Hsinchu (TW); Yen-Lin Liao, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 48 days.

(21) Appl. No.: 17/144,285

(22) Filed: Jan. 8, 2021

(65) Prior Publication Data

US 2021/0218147 A1 Jul. 15, 2021

(30) Foreign Application Priority Data

Jan. 10, 2020 (TW) ..... 109200423

(51) Int. Cl.
*H01Q 13/20* (2006.01)
*H01Q 21/10* (2006.01)
(Continued)

(52) U.S. Cl.
CPC ..... *H01Q 13/206* (2013.01); *H01Q 1/38* (2013.01); *H01Q 5/357* (2015.01);
(Continued)

(58) Field of Classification Search
CPC ..... H01Q 13/206; H01Q 1/38; H01Q 21/065; H01Q 9/065; H01Q 5/357
See application file for complete search history.

(56) References Cited

U.S. PATENT DOCUMENTS 5,963,168 A * 10/1999 Brennan ..... H01Q 21/10 343/790
8,432,314 B2 * 4/2013 Mao ..... H01Q 1/523 343/846
(Continued)

FOREIGN PATENT DOCUMENTS

CN 102110904 A * 6/2011 ..... H01Q 1/242

OTHER PUBLICATIONS

Collinear Microstrip Patch Antenna. Milan Polívka et al. (Year: 2005).*
(Continued)

*Primary Examiner* — Vibol Tan
(74) *Attorney, Agent, or Firm* — Birch, Stewart, Kolasch & Birch, LLP

(57) ABSTRACT

A microstrip collinear array includes a bearing member, two first antenna assemblies, two second antenna assemblies, a first connecting line, and a second connecting line. The two first antenna assemblies are juxtaposed on the bearing member. Each of the first antenna assemblies includes several first planar antennas. The two second antenna assemblies are juxtaposed on the bearing member and are respectively and correspondingly located on an opposite side of the two first antenna assemblies. Each of the second antenna assemblies includes several second planar antennas. The first connecting line and the second connecting line are disposed on the bearing member. The second connecting line is located on an opposite side of the first connecting line and is electrically connected to the first connecting line. The first connecting line is electrically connected to the first antenna assemblies. The second connecting line is electrically connected to the second antenna assemblies.

11 Claims, 17 Drawing Sheets

(51) Int. Cl.

| | |
|---|---|
| ***H01Q 21/12*** | (2006.01) |
| ***H01Q 5/357*** | (2015.01) |
| ***H01Q 21/06*** | (2006.01) |
| ***H01Q 1/38*** | (2006.01) |

(52) U.S. Cl.
CPC ..... *H01Q 21/065* (2013.01); *H01Q 21/10* (2013.01); *H01Q 21/12* (2013.01)

(56) References Cited

U.S. PATENT DOCUMENTS

| | | | | |
|---|---|---|---|---|
| 8,912,960 | B1 * | 12/2014 | Andrenko | H01Q 1/38 343/895 |
| 11,223,141 | B2 * | 1/2022 | Liu | H01Q 21/061 |
| 2010/0134376 | A1 * | 6/2010 | Margomenos | H01Q 21/065 343/860 |

OTHER PUBLICATIONS

Millimeter-Wave Conformal Antenna Array for 5G Wireless Applications. Syeda Fizzah Jilani et al. (Year: 2017).*
Planar version of Collinear Microstrip Patch Antenna. Milan Polívka et al. Date Unknown.*
Collinear Microstrip Patch Antennas. Alois Holub et al. (Year: 2010).*

* cited by examiner

MICROSTRIP COLLINEAR ARRAY

BACKGROUND OF THE INVENTION

Technical Field

The present disclosure is related to an antenna, and more particularly to a microstrip collinear array.

Description of Related Art

With the advancement in wireless communications, such as wireless local area networks or mobile communication products, the demand for wireless signal bandwidth and data transmission rates is increasing. Therefore, there is a need for manufacturers to develop an antenna module with high peak gain and high wireless transmission rates.

A conventional antenna module which is a microstrip collinear array includes a carrier board and an antenna assembly disposed on a surface of the carrier board, wherein the antenna assembly has a plurality of planar antennas arranged in a predetermined axial direction. In order to achieve high peak gain, the number of the planar antennas of the conventional antenna module has to increase. However, as the number of planar antennas increases, a length of the carrier board also needs to be increased accordingly. In pursuit of miniaturization of access point, the carrier board of the conventional antenna module is too long, which is not favorable for miniature access point.

BRIEF SUMMARY OF THE INVENTION

In view of the above, the purpose of the present disclosure is to provide a microstrip collinear array, which could facilitate high peak gain and could reduce length in overall of an antenna module.

The present disclosure provides a microstrip collinear array, including a bearing member, two first antenna assemblies, two second antenna assemblies, a first connecting line, and a second connecting line, wherein the bearing member has a first end and a second end opposite to the first end in a first axial direction. The two first antenna assemblies are juxtaposed on the bearing member, wherein each of the first antenna assemblies includes a plurality of first planar antennas, a plurality of first transmission lines, and a first extending line; the first planar antennas of each of the first antenna assemblies are arranged at intervals in the first axial direction. Two ends of each of the first transmission lines of each of the first antenna assemblies are respectively connected to the two adjacent first planar antennas. The first extending line of each of the first antenna assemblies is connected to one of the first planar antennas closest to the first end. The two second antenna assemblies are juxtaposed on the bearing member and respectively and correspondingly located on a surface of the bearing member opposite to the first antenna assemblies, wherein each of the second antenna assemblies includes a plurality of second planar antennas, a plurality of second transmission lines, and a second extending line; the second planar antennas of each of the second antenna assemblies are arranged at intervals in the first axial direction. Two ends of each of the second transmission lines of each of the second antenna assemblies are respectively connected to the two adjacent second planar antennas. The second extending line of each of the second antenna assemblies is connected to one of the second planar antennas closest to the second end. The first connecting line is disposed on the bearing member, wherein the first connecting line includes a first connecting section and a first driving section. The first connecting section extends in a second axial direction and is electrically connected to the first antenna assemblies. The second connecting line is disposed on the bearing member and is located on a side of the bearing member opposite to the first connecting line. The second connecting line is electrically connected to the first connecting line and includes a second connecting section and a second driving section. The second connecting section extends in the second axial direction and is electrically connected to the second antenna assemblies.

With the aforementioned design, by juxtaposing the two first antenna assemblies and the two second antenna assemblies, the microstrip collinear array of the present disclosure could effectively reduce the overall length, and could achieve high peak gain, and could be adapted for miniaturization access point.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1A:
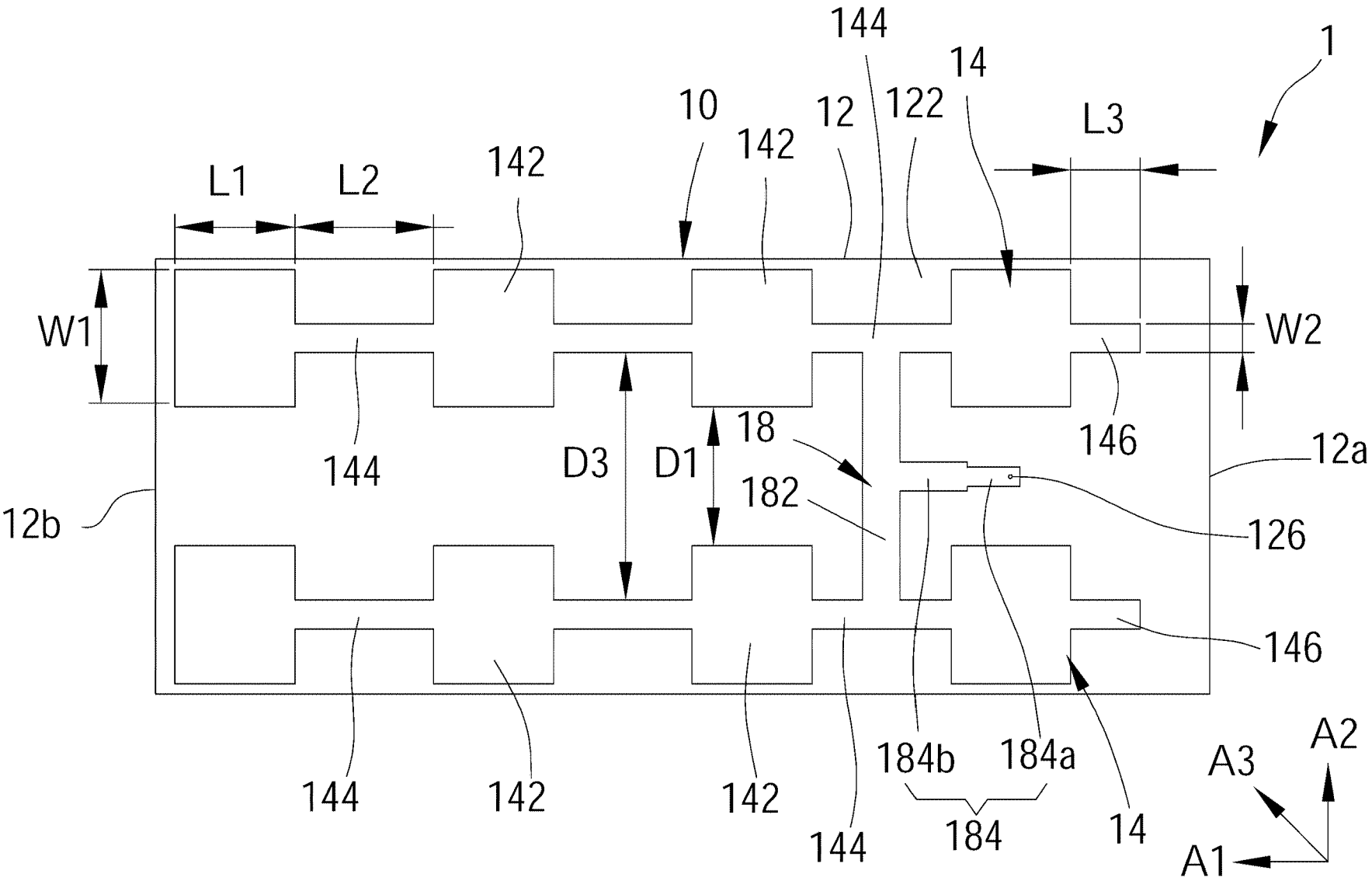
FIG. 1*a* is a top view of the microstrip collinear array according to a first embodiment of the present disclosure.
Figure 1B:
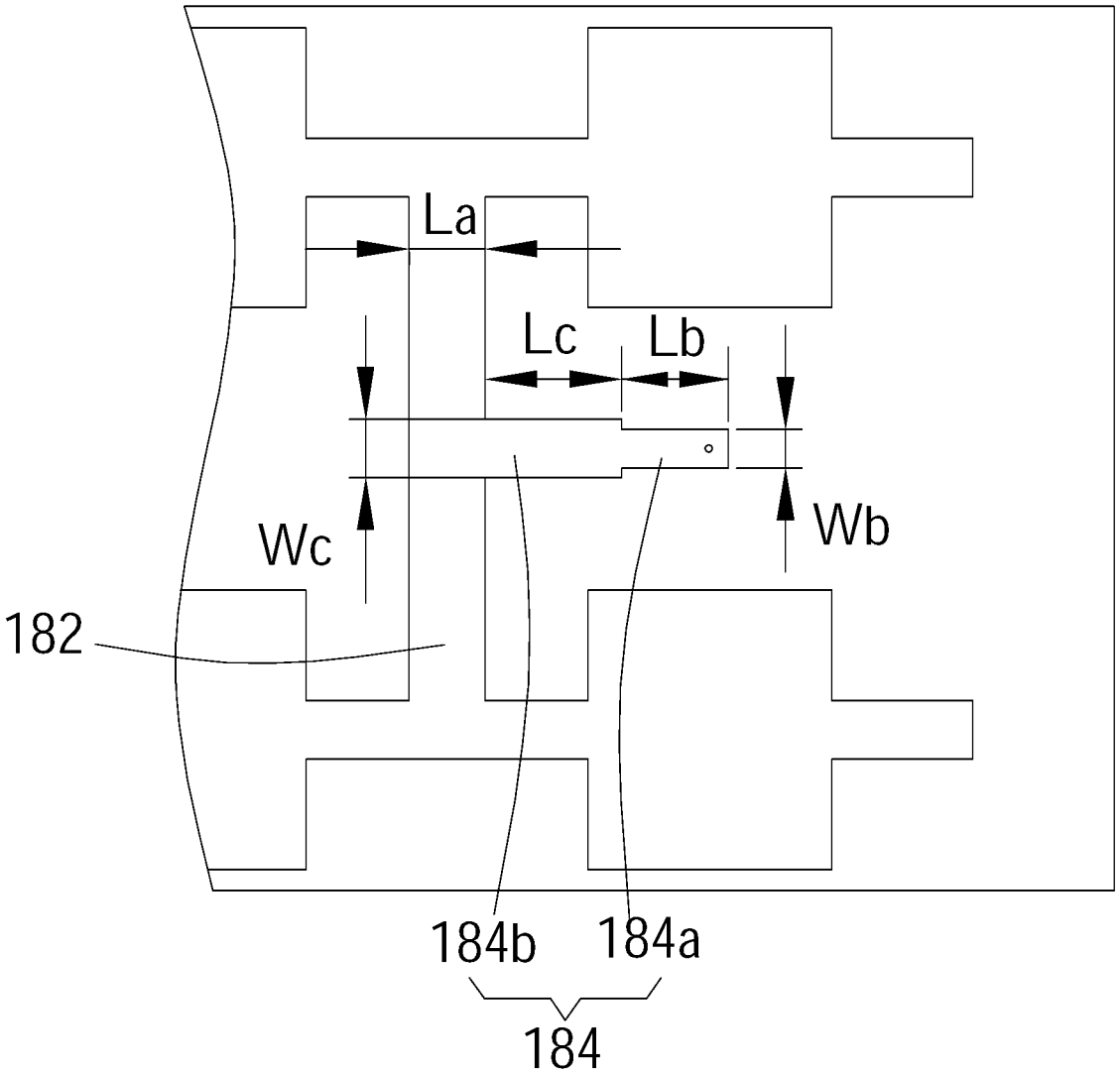
FIG. 1*b* is a partially enlarged view of FIG. 1*a;*

A microstrip collinear array 1 according to a first embodiment of the present disclosure is illustrated in FIG. 1*a* to FIG. 2*b*, and includes a bearing member 10, two first antenna assemblies 14, two second antenna assemblies 16, a first connecting line18, and a second connecting line 20.

The bearing member 10 includes a bearing plate 12, wherein the bearing plate 12 is long and rectangular and has a first surface 122 and a second surface 124 which face opposite directions. A longitudinal axis direction of the bearing plate 12 extends in a first axial direction A1, and a latitudinal direction of the bearing plate 12 extends in a second axial direction A2, wherein the first axial direction A1 is perpendicular to the second axial direction A2. The bearing plate 12 has a first end 12*a* and a second end 12*b* which is opposite to the first end 12*a* in the first axial direction A1. In the current embodiment, a length of the bearing plate 12 in the longitudinal axis direction is 110 mm, and a width of the bearing plate 12 in the latitudinal direction is 47.37 mm. A material of the bearing plate 12 could be selected from, but not limited to, ceramic-filled PTFE (Polytetrafluoroethylene) based laminates or reinforced hydrocarbon/ceramic laminates.

Two first antenna assemblies 14 are juxtaposed on the bearing member 10. In the current embodiment, the two first antenna assemblies 14 are juxtaposed on the first surface 122 of the bearing plate 12, wherein each of the first antenna assemblies 14 includes a plurality of first planar antennas 142, a plurality of first transmission lines 144, and a first extending line 146. In the current embodiment, each of the first antenna assemblies 14 includes at least four first planar antennas 142 and at least three first transmission lines 144, wherein the four first planar antennas 142 of each of the first antenna assemblies 14 are arranged at intervals in the first axial direction A1. Two ends of each of the first transmission lines 144 of each of the first antenna assemblies 14 are respectively connected to the two adjacent first planar antennas 142. The first extending line 146 of each of the first antenna assemblies 14 is connected to one of the first planar antennas 142 closest to the first end 12*a*. The first transmission lines 144 and the first extending line 146 of each of the first antenna assemblies 14 are located at a same axis.

Two second antenna assemblies 16 are juxtaposed on the bearing member 10 and are located on a surface of the bearing member 10 opposite to the first antenna assemblies 14. In the current embodiment, the two second antenna assemblies 16 are juxtaposed on the second surface 124 of the bearing plate 12, wherein each of the second antenna assemblies 16 includes a plurality of second planar antennas 162, a plurality of second transmission lines 164, and a second extending line 166. In the current embodiment, each of the second antenna assemblies 16 includes at least four second planar antennas 162 and at least three second transmission lines 164, wherein the four second planar antennas 162 of each of the second antenna assemblies 16 are arranged at intervals in the first axial direction A1. Two ends of each of the second transmission lines 164 of each of the second antenna assemblies 16 are respectively connected to two adjacent second planar antennas 162. The second extending line 166 of each of the second antenna assemblies 16 is connected to one of the second planar antennas 162 closest to the second end 12*b*.

Figure 2A:
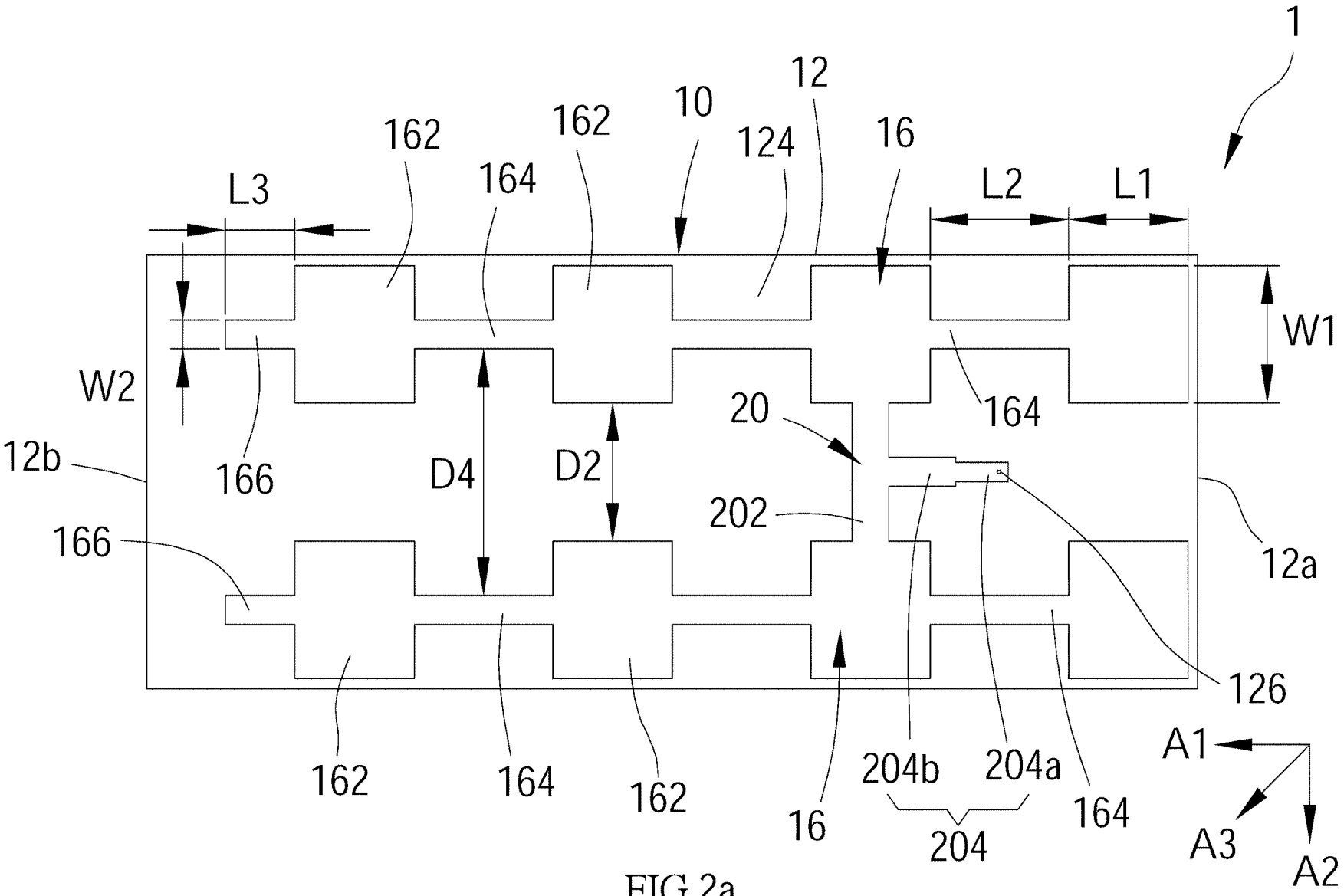
FIG. 2*a* is a bottom view of the microstrip collinear array according to the first embodiment of the present disclosure.
Figure 2B:
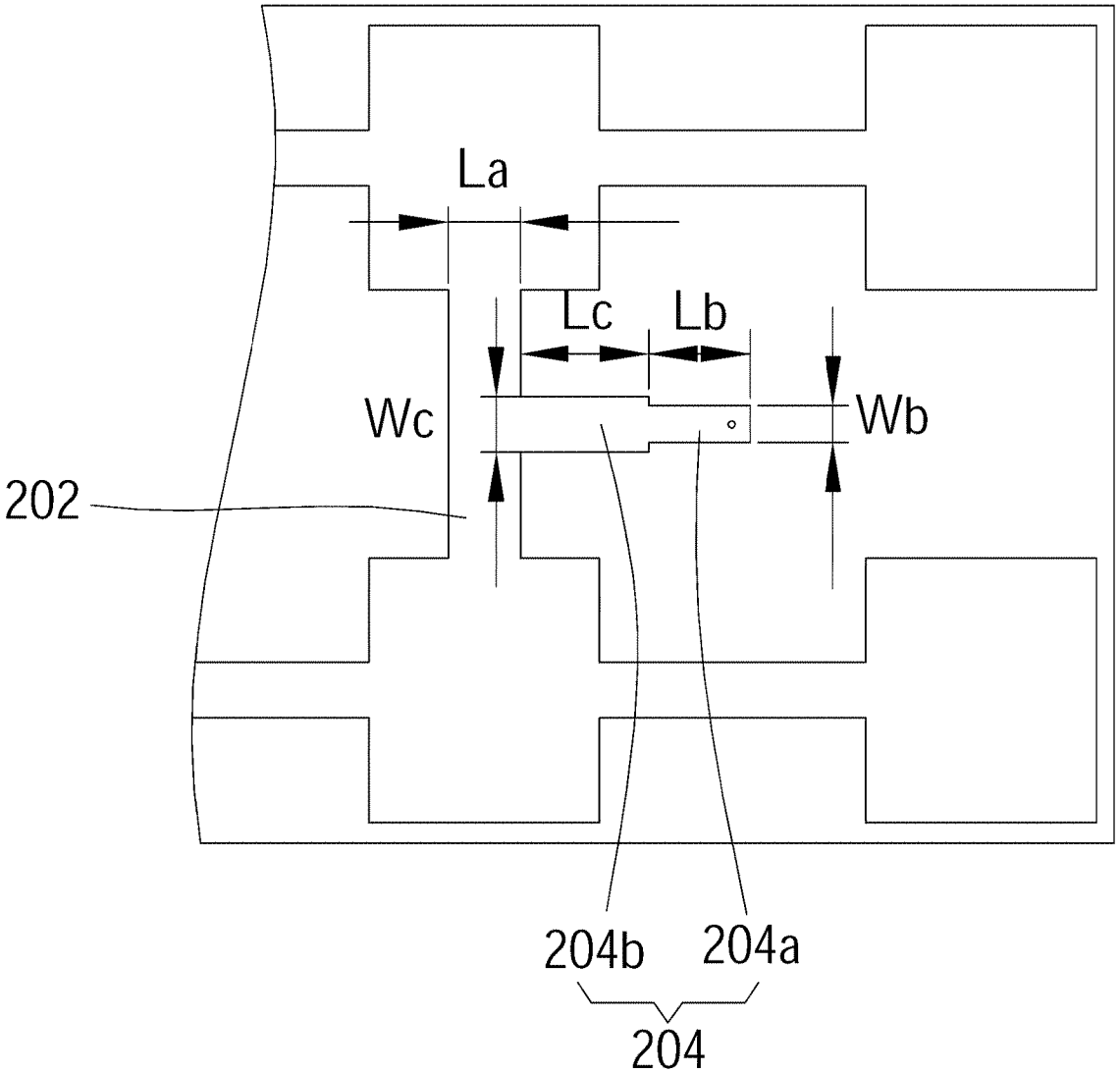
FIG. 2*b* is a partially enlarged view of FIG. 2*a;*

In the current embodiment, the first planar antennas 142 of each of the first antenna assemblies 14 on the first surface 122 and the corresponding second planar antennas 162 of one of the second antenna assemblies 16 on the second surface 124 are arranged in a staggered manner in the first axial direction A1. Each of the first planar antennas 142 and each of the second planar antennas 162 do not overlap in a third axial direction A3 perpendicular to the first surface 122 and the second surface 124, wherein the third axial direction A3 in FIG. 1*a* is a direction looking into FIG. 1*a*, and the third axial direction A3 in FIG. 2*a* is a direction looking out from FIG. 2*a*.

The first connecting line 18 is disposed on the first surface 122 of the bearing plate 12 and includes a first connecting section 182 and a first driving section 184, wherein the first connecting section 182 extends in the second axial direction A2, and two ends of the first connecting section 182 are respectively and electrically connected to the two first antenna assemblies 14. More specifically, the two ends of the first connecting section 182 respectively connected to the two first transmission lines 144 of the two first antenna assemblies 14 closest to the first end 12*a*. The first driving section 184 is connected to the first connecting section 182 and includes a first segment 184*a* and a second segment 184*b*, wherein both of the first segment 184*a* and the second segment 184*b* extend in the first axial direction A1. The second segment 184*b* is connected between the first segment 184*a* and the first connecting section 182. The first segment 184*a* is adapted to be connected to a wireless signal transceiver (not shown). A width of the first segment 184*a* in the second axial direction A2 is smaller than a width of the second segment 184*b* in the second axial direction A2.

The second connecting line 20 is disposed on the second surface 124 of the bearing plate 12 which is opposite to the first connecting line 18 and corresponds to the first connecting line 18. The second connecting line 20 is electrically connected to the first connecting line 18 and includes a second connecting section 202 and a second driving section 204, wherein the second connecting section 202 extends in the second axial direction A2 and is electrically connected to the two second antenna assemblies 16. More specifically, two ends of the second connecting section 202 are respectively and electrically connected to the two corresponding second planar antennas 162 of the two second antenna assemblies 16. The second driving section 204 is connected to the second connecting section 202. The first connecting line 18 overlaps with the second connecting line 20 in the third axial direction A3. The second driving section 204 is electrically connected to the first driving section 184 via a conductive hole 126 on the bearing plate 12. In the current embodiment, the second driving section 204 includes a third segment 204*a* and a fourth segment 204*b*, wherein both of the third segment 204*a* and the fourth segment 204*b* extends in the first axial direction A1. The fourth segment 204*b* is connected between the third segment 204*a* and the second connecting section 202. A width of the third segment 204*a* in the second axial direction A2 is smaller than a width of the fourth segment 204*b* in the second axial direction A2. The conductive hole 126 is located between the third segment 204*a* of the second driving section 204 and the first segment 184*a* of the first driving section 184.

Each of the first planar antennas 142 and each of the second planar antennas 162 have a first length L1 in the first axial direction A1 and have a first width W1 in the second axial direction A2. In the current embodiment, the first length L1 is 12.5 mm, and the first width W1 is 14 mm. Each of the first transmission lines 144 and each of the second transmission lines 164 have a second length L2 in the first axial direction A1. In the current embodiment, the second length L2 is 14.5 mm. Each of the first extending lines 146 and each of the second extending lines 166 have a third length L3 in the first axial direction A1. In the current embodiment, the third length L3 is 8.55 mm. Each of the first transmission lines 144, each of the second transmission lines 164, each of the first extending lines 146, and each of the second extending lines 166 have a second width W2 in the second axial direction A2, wherein the second width W2 is 2.9-3.1 mm. In the current embodiment, the second width W2 is 3.1 mm.

The first planar antennas 142 of one of the first antenna assemblies 14 are spaced from the first planar antennas 142 of the other first antenna assembly 14 by a first distance D1 in the second axial direction A2. In the current embodiment, the first distance D1 is 14.5 mm. The second planar antennas 162 of one of the second antenna assemblies 16 are spaced from the second planar antennas 162 of the other second antenna assembly 16 by a second distance D2 in the second axial direction A2. In the current embodiment, the second distance D2 is 14.5 mm.

The first transmission lines 144 of one of the first antenna assemblies 14 are spaced from the first transmission lines 144 of the other first antenna assembly 14 by a third distance D3 in the second axial direction A2. In the current embodiment, the third distance D3 is 25.4 mm. The second transmission lines 164 of one of the second antenna assemblies 16 are spaced from the second transmission lines 164 of the other second antenna assembly 16 by a fourth distance D4 in the second axial direction A2. In the current embodiment, the fourth distance is 25.4 mm.

In the current embodiment, the first connecting section 182 of the first connecting line 18 and the second connecting section 202 of the second connecting line 20 have a length La of 3.9 mm in the first axial direction A1, and the first segment 184*a* of the first driving section 184 has a length Lb of 5.5 mm in the first axial direction A1, and the second segment 184*b* of the first driving section 184 has a length Lc of 7 mm in the first axial direction A1. The first segment 184*a* of the first driving section 184 has a width Wb of 2 mm in the second axial direction A2, and the second segment 184*b* of the first driving section 184 has a width Wc of 3 mm in the second axial direction A2. The second driving section 204 and the first driving section 184 have the same size.

Generally, in order to achieve similar high peak gain by a merely single antenna assembly, the antenna assembly should include at least six planar antennas and a bearing plate with a length over 164 mm. In the current embodiment, a length of the bearing plate 12 of the bearing member 10 of the microstrip collinear array 1 is 110 mm, which could provide high peak gain without increasing the length of the bearing member. Other embodiments are described in detail as follow, which could provide high peak gain as well.

Figure 3:
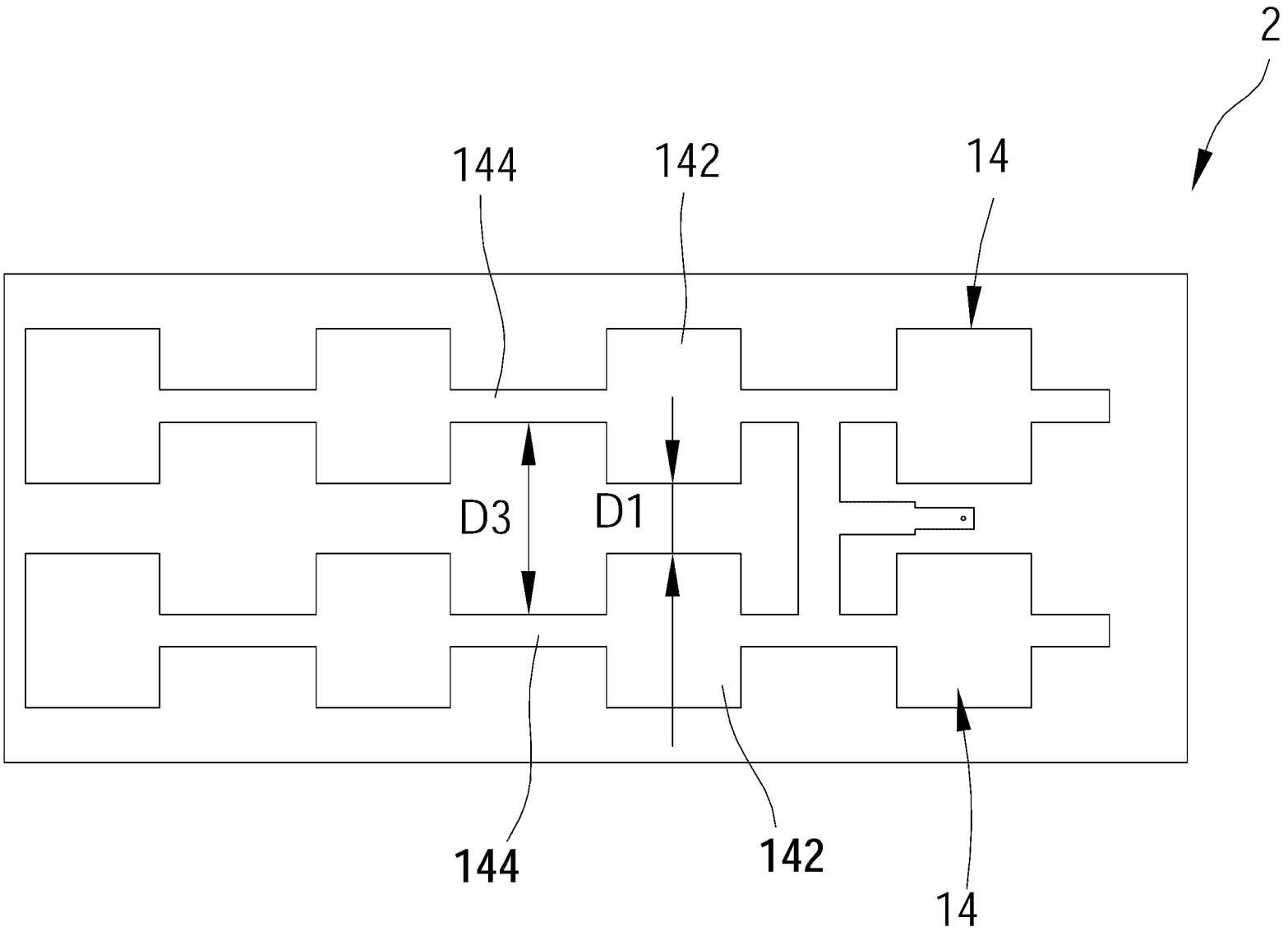
FIG. 3 is a top view of the microstrip collinear array according to a second embodiment of the present disclosure.
Figure 4:
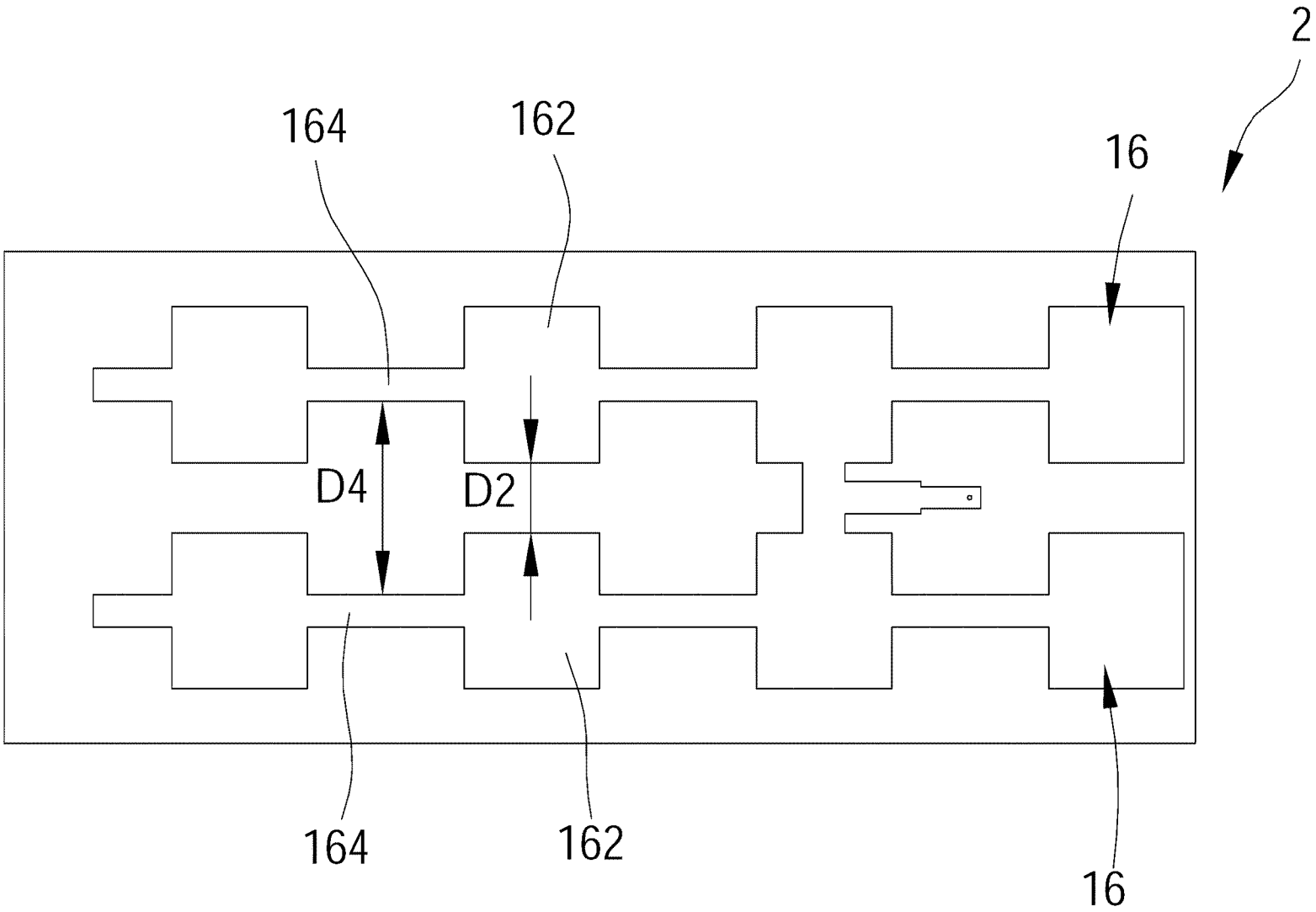
FIG. 4 is a bottom view of the microstrip collinear array according to the second embodiment of the present disclosure.

A microstrip collinear array 2 according to a second embodiment of the present disclosure is illustrated in FIG. 3 and FIG. 4, and has almost the same structures as that of the first embodiment, except that the first distance D1 between the first planar antennas 142 of the two first antenna assemblies 14 is 6.5 mm; the second distance D2 between the second planar antennas 162 of the two second antenna assemblies 16 is 6.5 mm; the third distance D3 between the first transmission lines 144 of the two first antenna assemblies 14 is 17.4 mm; the fourth distance D4 between the second transmission lines 164 of the two second antenna assemblies 16 is 17.4 mm.

Figure 5:
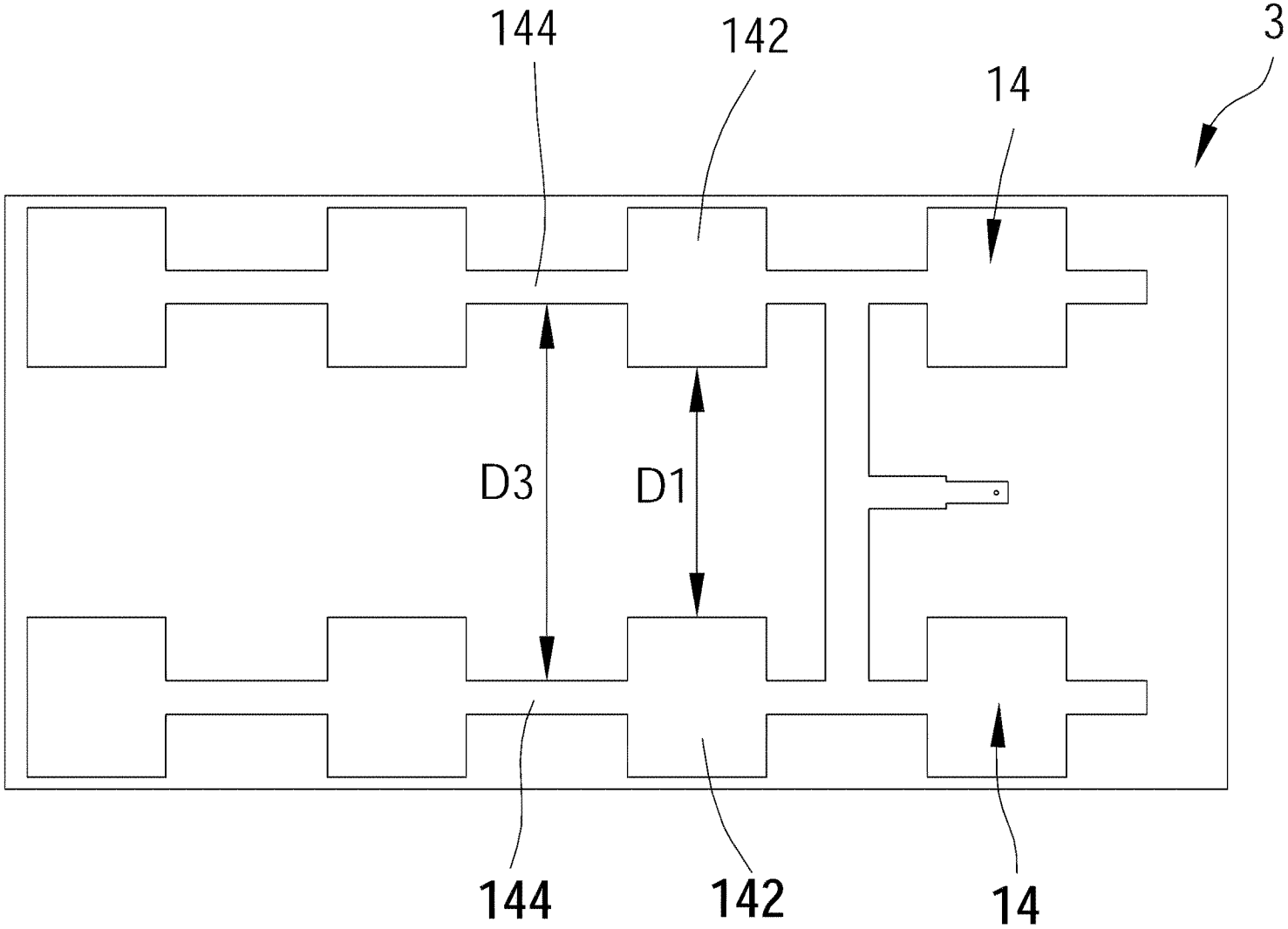
FIG. 5 is a top view of the microstrip collinear array according to a third embodiment of the present disclosure.
Figure 6:
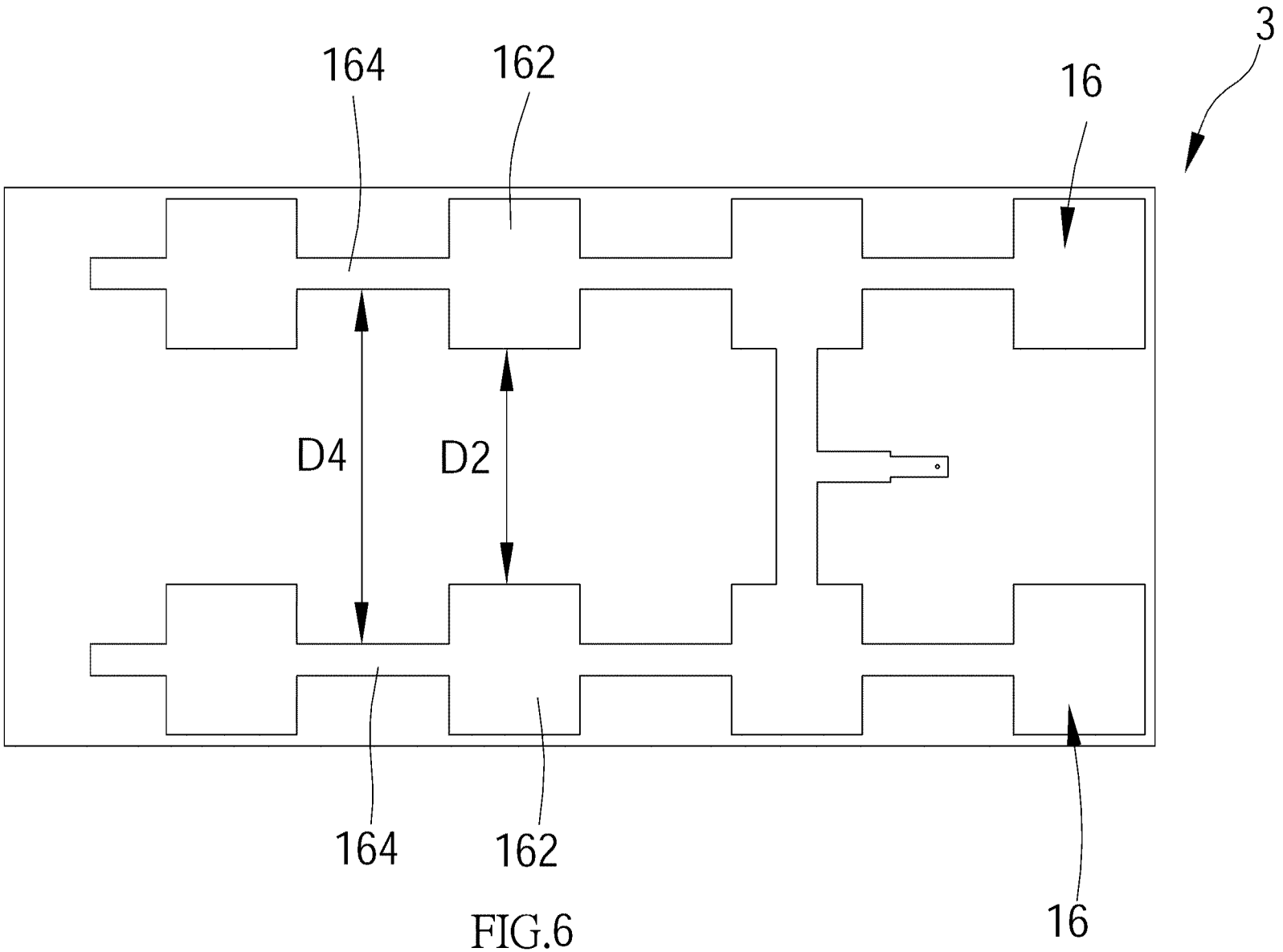
FIG. 6 is a bottom view of the microstrip collinear array according to the third embodiment of the present disclosure.

A microstrip collinear array 3 according to a third embodiment of the present disclosure is illustrated in FIG. 5 and FIG. 6, and has almost the same structures as that of the first embodiment, except that the first distance D1 between the first planar antennas 142 of the two first antenna assemblies 14 is 22.5 mm; the second distance D2 between the second planar antennas 162 of the two second antenna assemblies 16 is 22.5 mm; the third distance D3 between the first transmission lines 144 of the two first antenna assemblies 14 is 33.4 mm; the fourth distance D4 between the second transmission lines 164 of the two second antenna assemblies 16 is 33.4 mm.

Figure 7:
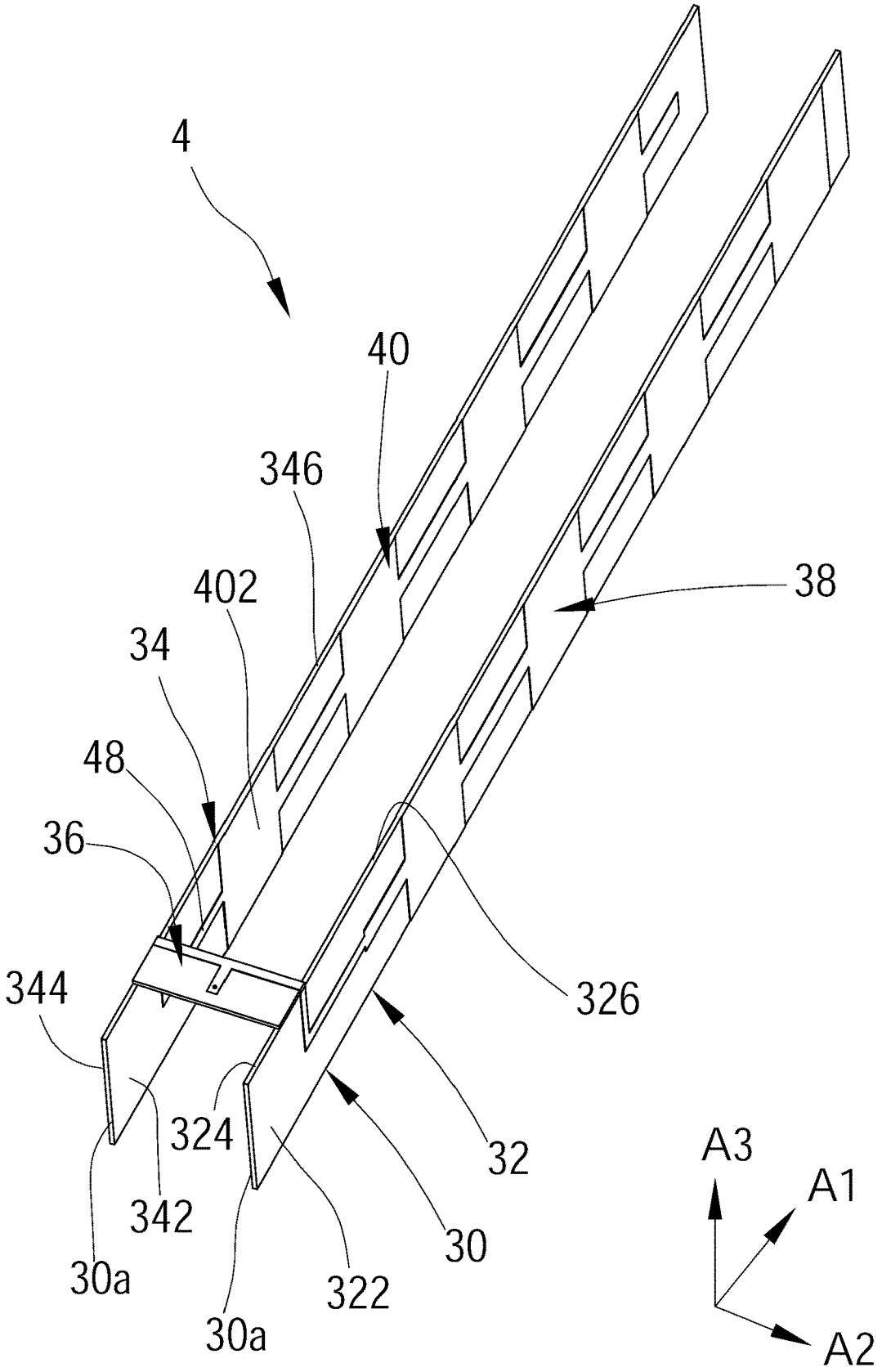
FIG. 7 is a perspective view of the microstrip collinear array according to a fourth embodiment of the present disclosure.
Figure 8:
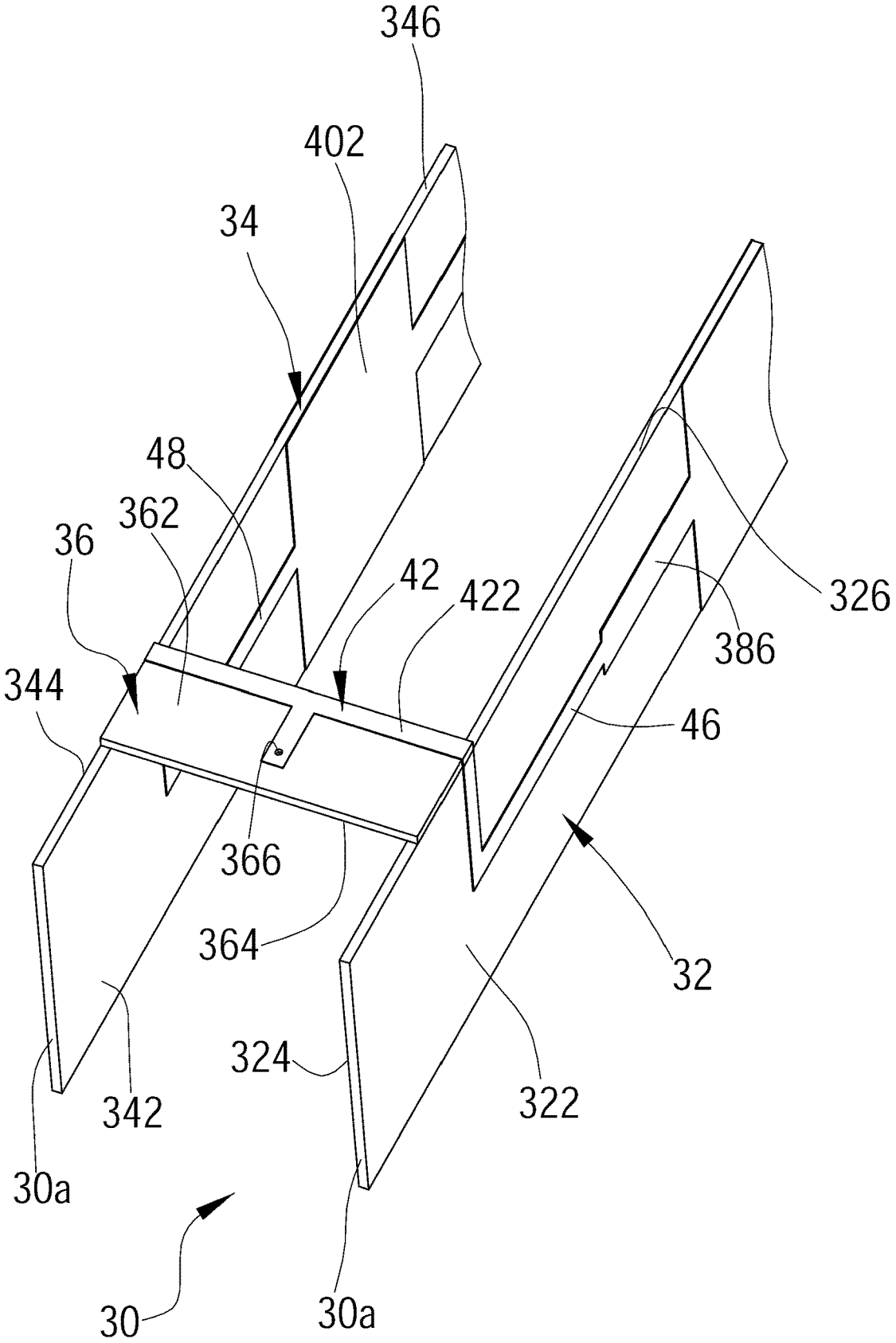
FIG. 8 is a partially enlarged view of FIG. 7.
Figure 9:
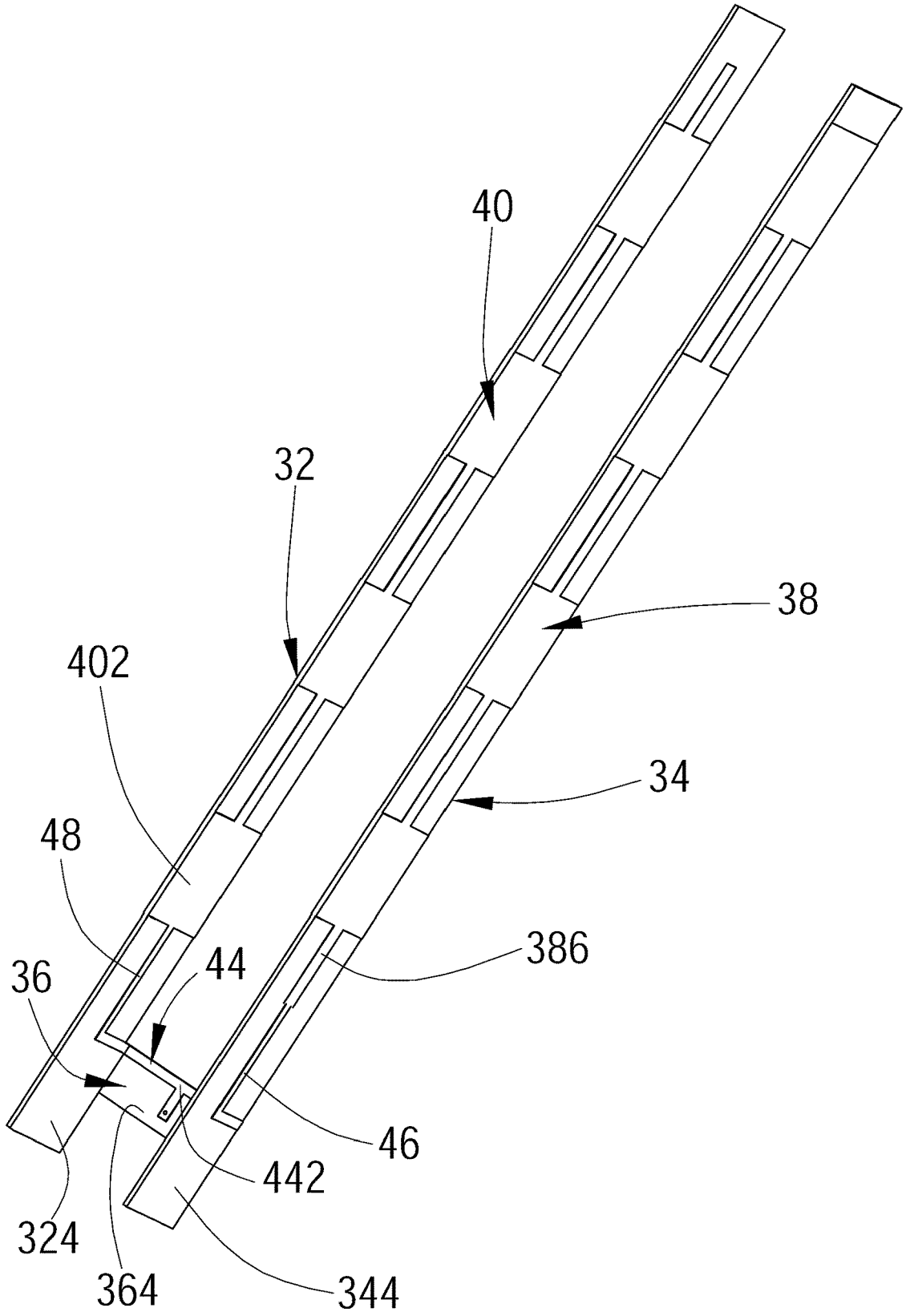
FIG. 9 is a perspective view, showing the microstrip collinear array according to the fourth embodiment of the present disclosure seen from another direction.

A microstrip collinear array 4 according to a fourth embodiment of the present disclosure is illustrated in FIG. 7 to FIG. 8, and has similar structures as that of the first embodiment, including a bearing member 30, two first antenna assemblies 38, two second antenna assemblies 40, a first connecting line 42, and a second connecting line 44, wherein a longitudinal axis direction of the bearing member 30 extends in a first axial direction A1, and a first connecting section 422 of the first connecting line 42 and a second connecting section 442 of the second connecting line 44 extends in a second axial direction A2.

The difference between the microstrip collinear array 4 of the fourth embodiment and that of the first embodiment is that the bearing member 30 includes a first bearing plate 32, a second bearing plate 34, and a connecting plate 36, wherein the first bearing plate 32 has a first surface 322 and a second surface 324 which face opposite directions; the second bearing plate 34 has a third surface 342 and a fourth surface 344 which face opposite directions; the connecting plate 36 is connected between a lateral edge 326 of the first bearing plate 32 and a lateral edge 346 of the second bearing plate 34, and has a fifth surface 362 and a sixth surface 364 which face opposite directions.

One of the first antenna assemblies 38 is located on the first surface 322 of the first bearing plate 32, and the other first antenna assembly 38 is located on the fourth surface 344 of the second bearing plate 34. One of the second antenna assemblies 40 is located on the second surface 324 of the first bearing plate 32, and the other second antenna assembly 40 is located on the third surface 342 of the second bearing plate 34. In other words, the two first antenna assemblies 38 face opposite directions, and the two second antenna assemblies 40 face each other. In practice, the two first antenna assemblies 38 could face each other, and the two second antenna assemblies 40 could face opposite directions.

The first connecting line 42 is located on the fifth surface 362 of the connecting plate 36, and the second connecting line 44 is located on the sixth surface 364 of the connecting plate 36, wherein the first connecting line 42 overlaps with the second connecting line 44 in a third axial direction A3 perpendicular to the first axial direction A1 and the second axial direction A2. The first driving section 424 is electrically connected to the second driving section 444 via a conductive hole 366 on the connecting plate 36.

Figure 10:
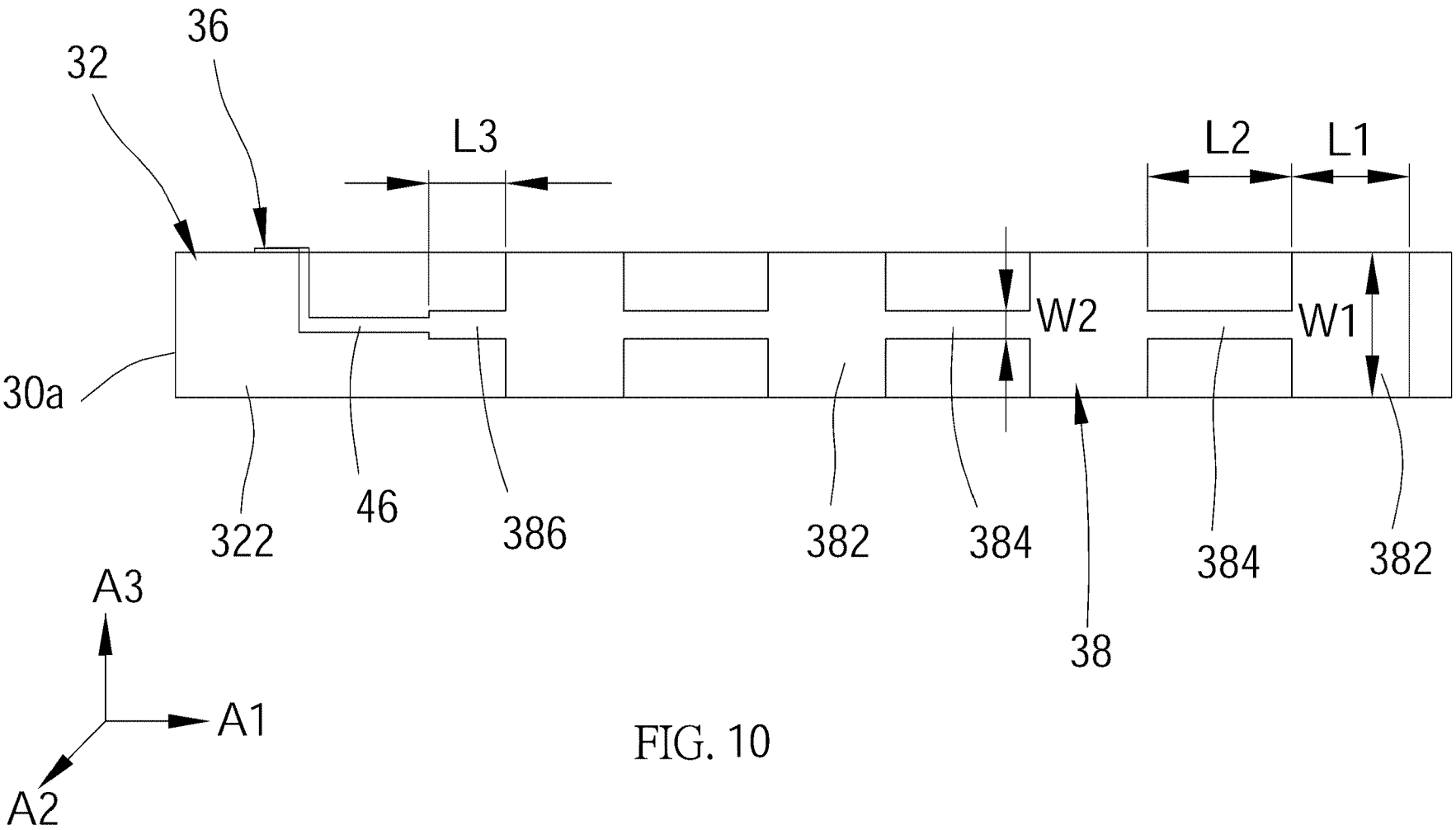
FIG. 10 is a side view, showing the first surface of the first bearing plate of the microstrip collinear array according to the fourth embodiment of the present disclosure.
Figure 11:
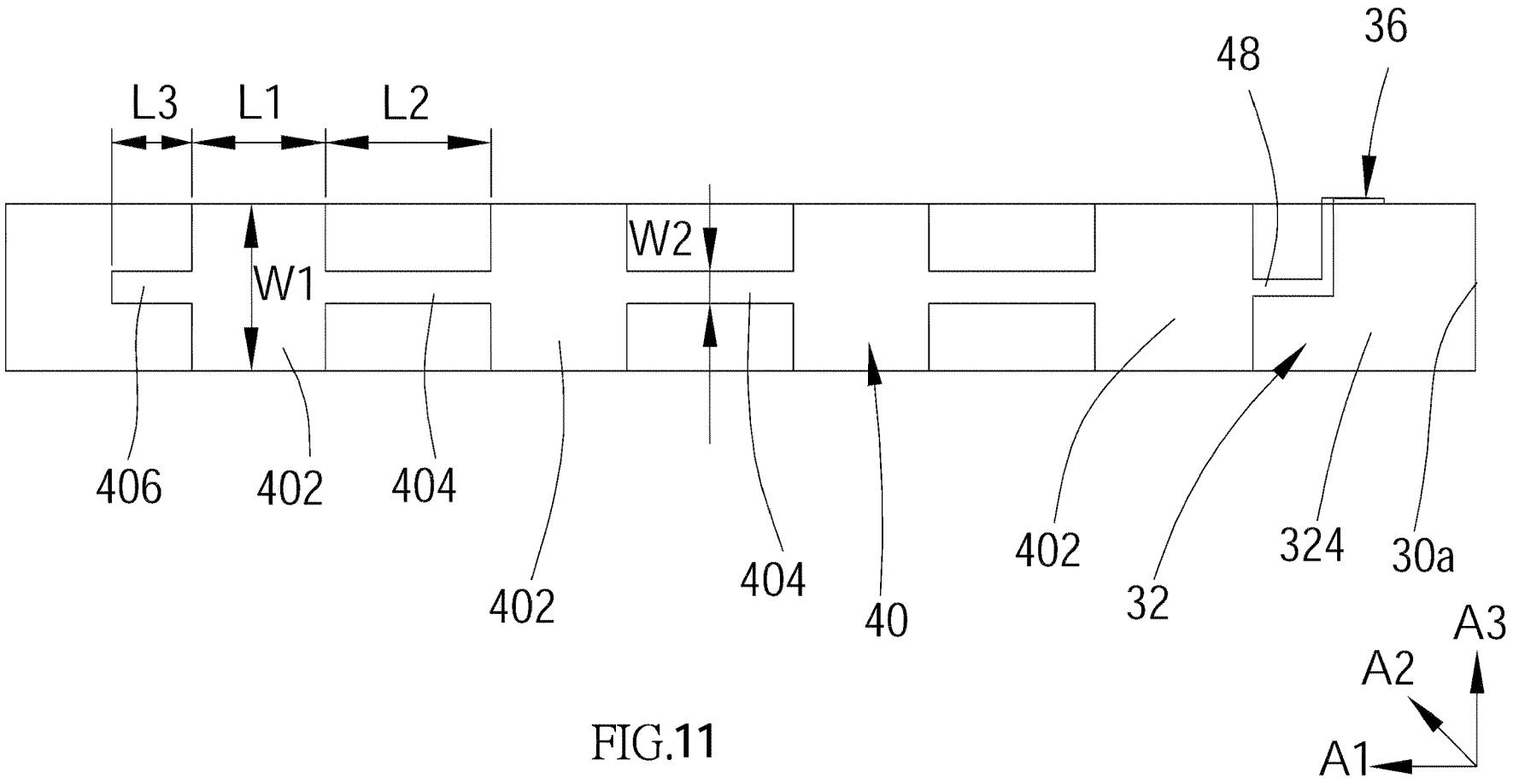
FIG. 11 is a side view, showing the second surface of the first bearing plate of the microstrip collinear array according to the fourth embodiment of the present disclosure.
Figure 12:
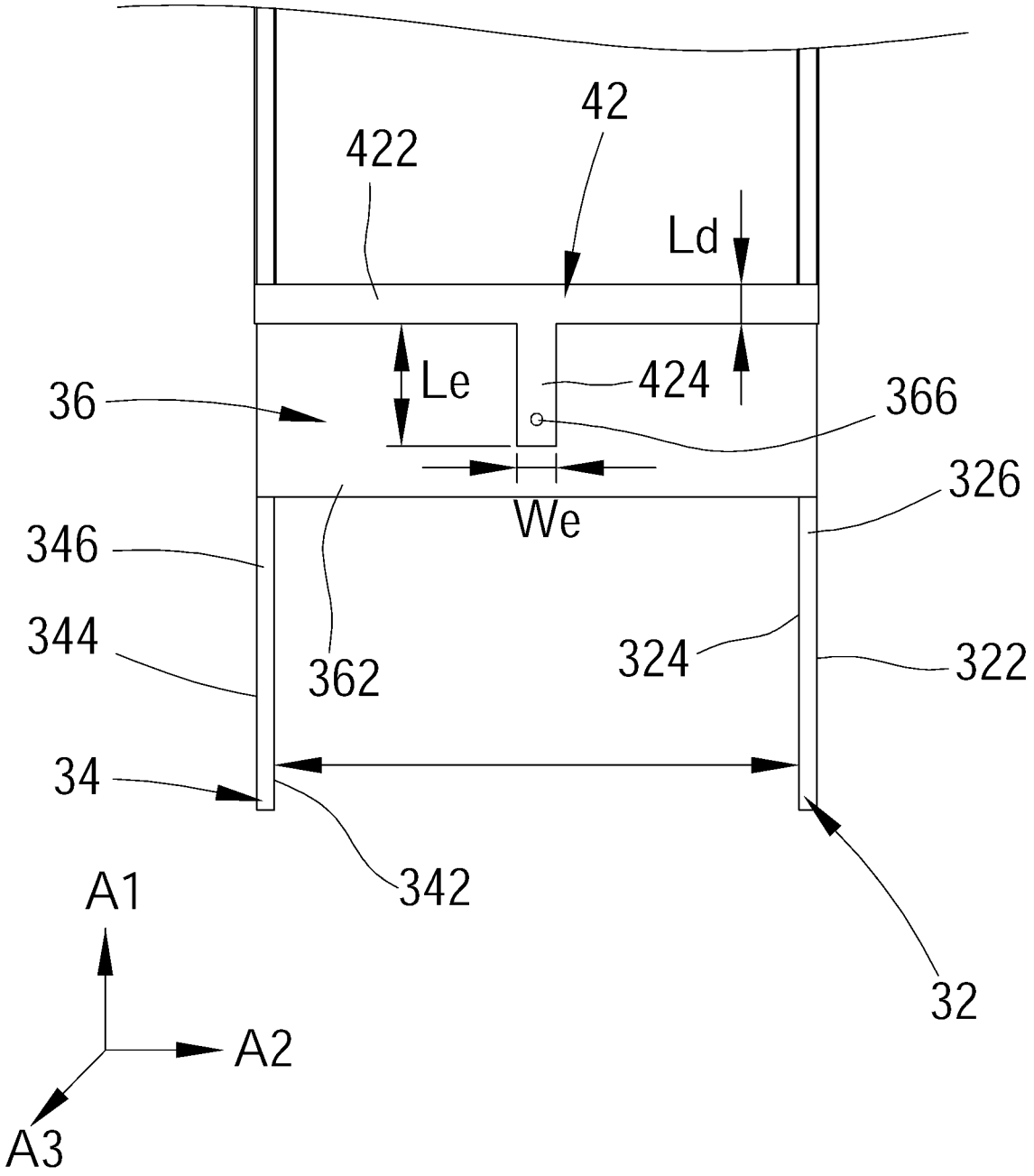
FIG. 12 is a top view of the first bearing plate of the microstrip collinear array according to the fourth embodiment of the present disclosure.
Figure 13:
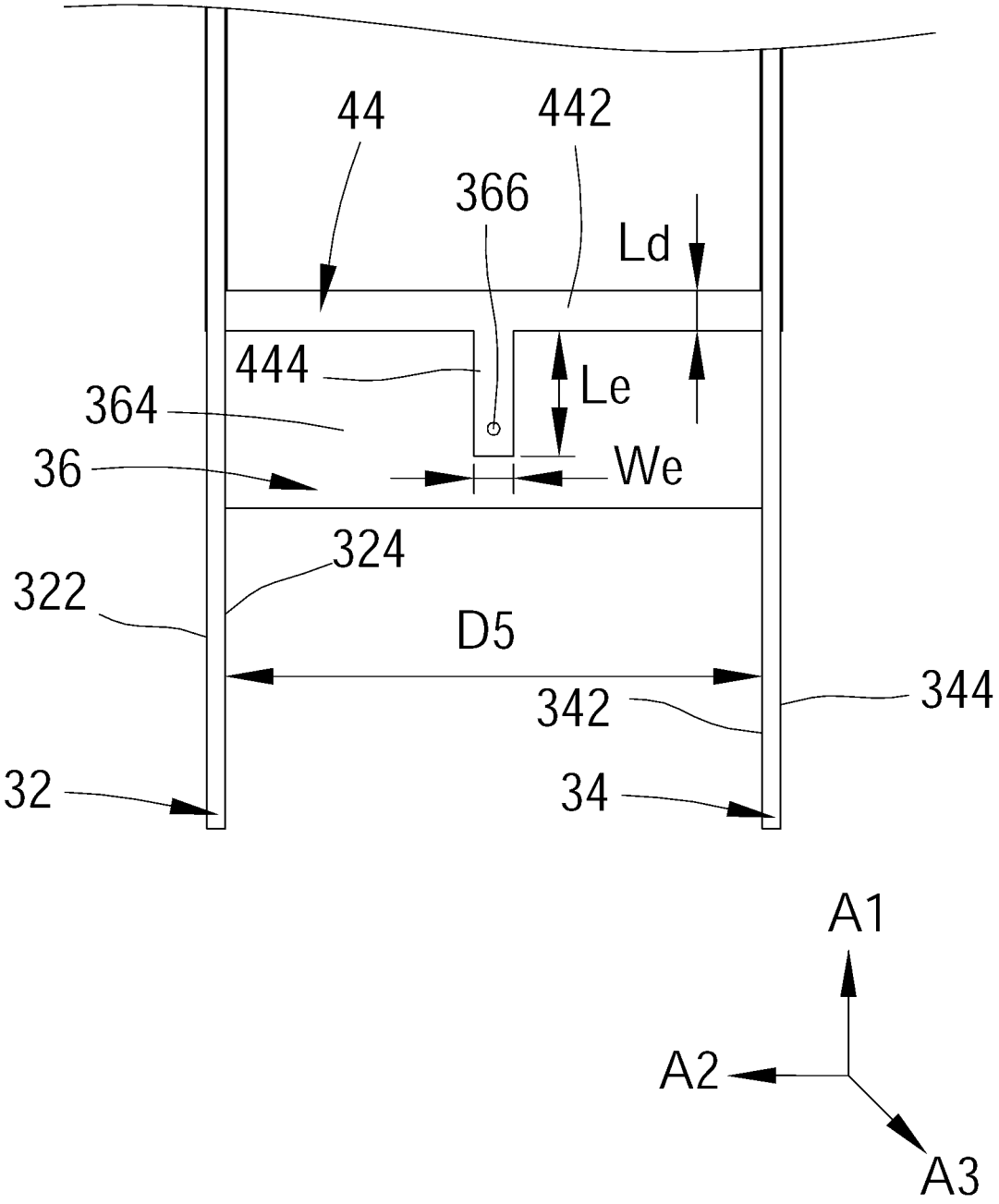
FIG. 13 is a bottom view of the microstrip collinear array according to the fourth embodiment of the present disclosure.

The first bearing plate 32 and the second bearing plate 34 have the same structure, in order to illustrate easily, the first bearing plate 32 is used for illustration. Referring to FIG. 10 and FIG. 11, the first bearing plate 32 has a length of 141.66 mm in a longitudinal axis direction of the first bearing plate 32 (i.e., the first axial direction A1) and has a width of 16 mm in a latitudinal direction of the first bearing plate 32 (i.e., the third axial direction A3). A plurality of first planar antennas 382 on the first surface 322 of the first bearing plate 32 and a plurality of second planar antennas 402 on the second surface 324 of the first bearing plate 32 are arranged in a staggered manner in the first axial direction A1. Each of the first planar antennas 382 and each of the second planar antennas 402 do not overlap in the second axial direction A2. The first planar antennas 382 on the second bearing plate 34 and the second planar antennas 402 on the second bearing plate 34 are arranged in a staggered manner in the first axial direction A1 as well.

A first extending line 386 of one of the first antenna assemblies 38 on the first surface 322 of the first bearing plate 32 is electrically connected to the first connecting section 422 of the first connecting line 42 on the connecting plate 36 via a conductive line 46. One of the second planar antennas 402 on the second surface 324 of the first bearing plate 32 closest to a first end 30*a* of the bearing member 30 is electrically connected to the second connecting section 442 of the second connecting line 44 on the connecting plate 36 via a conductive line 48. A first extending line 386 of the other first antenna assembly 38 on the fourth surface 344 of the second bearing plate 34 is electrically connected to the first connecting section 422 of the first connecting line 42 on the connecting plate 36 via a conductive line 46. One of the second planar antennas 402 on the third surface 342 of the second bearing plate 34 closest to the first end 30*a* is electrically connected to the second connecting section 442 of the second connecting line 44 on the connecting plate 36 via a conductive line 48.

In the current embodiment, each of the first planar antennas 382 and each of the second planar antennas 402 have a first length L1 in the first axial direction A1 and have a first width W1 in the third axial direction A3, wherein the first length L1 is 13.8 mm, and the first width W1 is 16 mm. Each of the first transmission lines 384 has a second length L2 in the first axial direction A1. In the current embodiment, the second length L2 is 15.8 mm. The second surface 324 and the third surface 342 are spaced from each other by a gap D5. In the current embodiment, the gap D5 is 15.8 mm.

Each of the first extending lines 386 and each of the second extending lines 406 have a third length L3 in the first axial direction A1. In the current embodiment, the third length L3 is 8.55 mm.

Each of the first transmission lines 384, each of the second transmission lines 404, each of the first extending lines 386, and each of the second extending lines 406 have a second width W2 in the third axial direction A3, wherein the second width W2 is 2.9-3.1 mm. In the current embodiment, the second width W2 is 2.9 mm. A maximum width of each of the conductive lines 46, 48 is 1.1 mm which is smaller than the second width W2.

In the current embodiment, the first connecting section 422 of the first connecting line 42 and the second connecting section 442 of the second connecting line 44 have a length Ld of 1.1 mm in the first axial direction A1; the first driving section 424 of the first connecting line 42 and the second driving section 444 of the second connecting line 44 have a length Le of 3.46 mm in the first axial direction A1 and have a width We of 1.1 mm in the second axial direction A2.

In the current embodiment, the bearing member 14 of the microstrip collinear array 4 has a length of 141.66 mm, which could also provide high peak gain at a length shorter than the bearing plate of a merely single antenna assembly.

Figure 14:
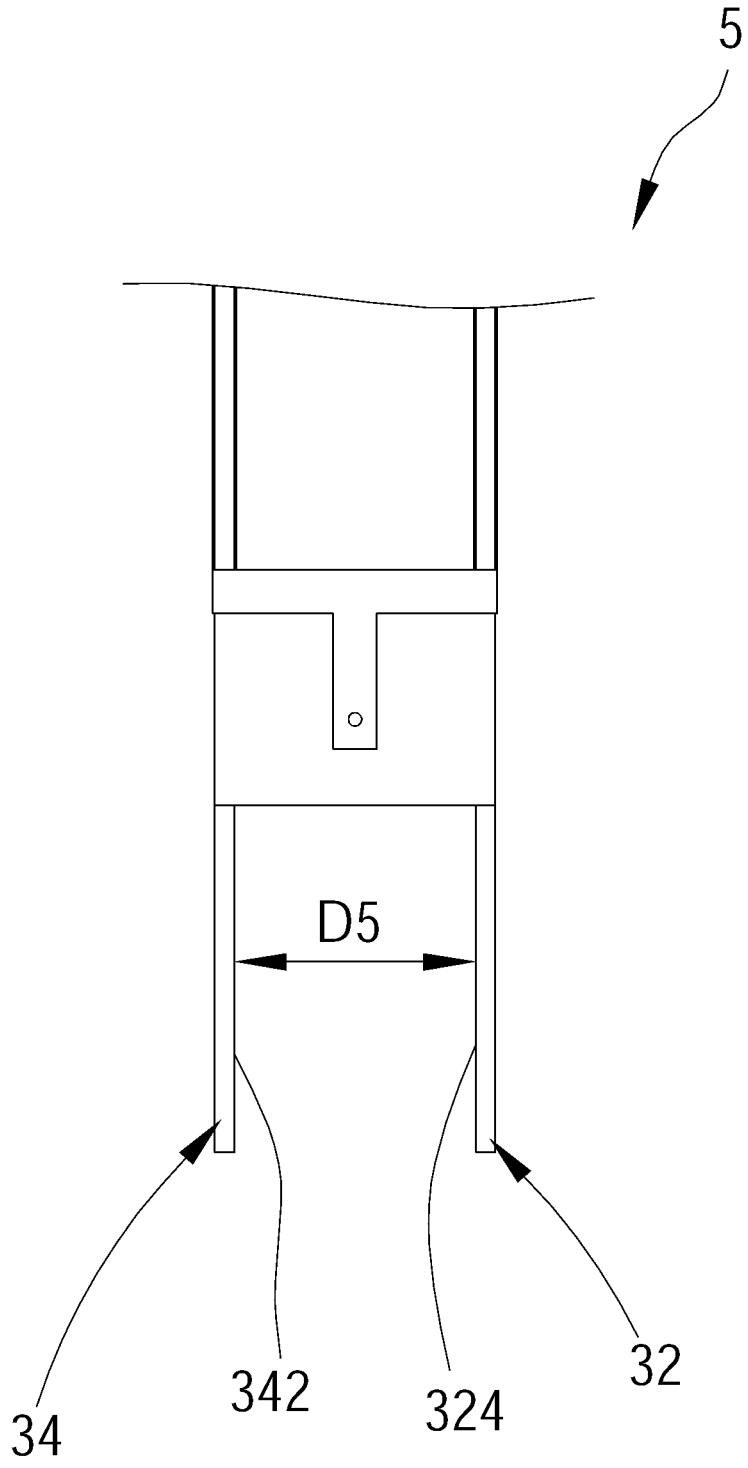
FIG. 14 is a top view of the microstrip collinear array according to a fifth embodiment of the present disclosure.

A microstrip collinear array 5 according to a fifth embodiment of the present disclosure is illustrated in FIG. 14, and has almost the same structures as that of the fourth embodiment, except that the gap D5 between the second surface 324 of the first bearing plate 32 and the third surface 342 of the second bearing plate 34 is 6.5 mm.

Figure 15:
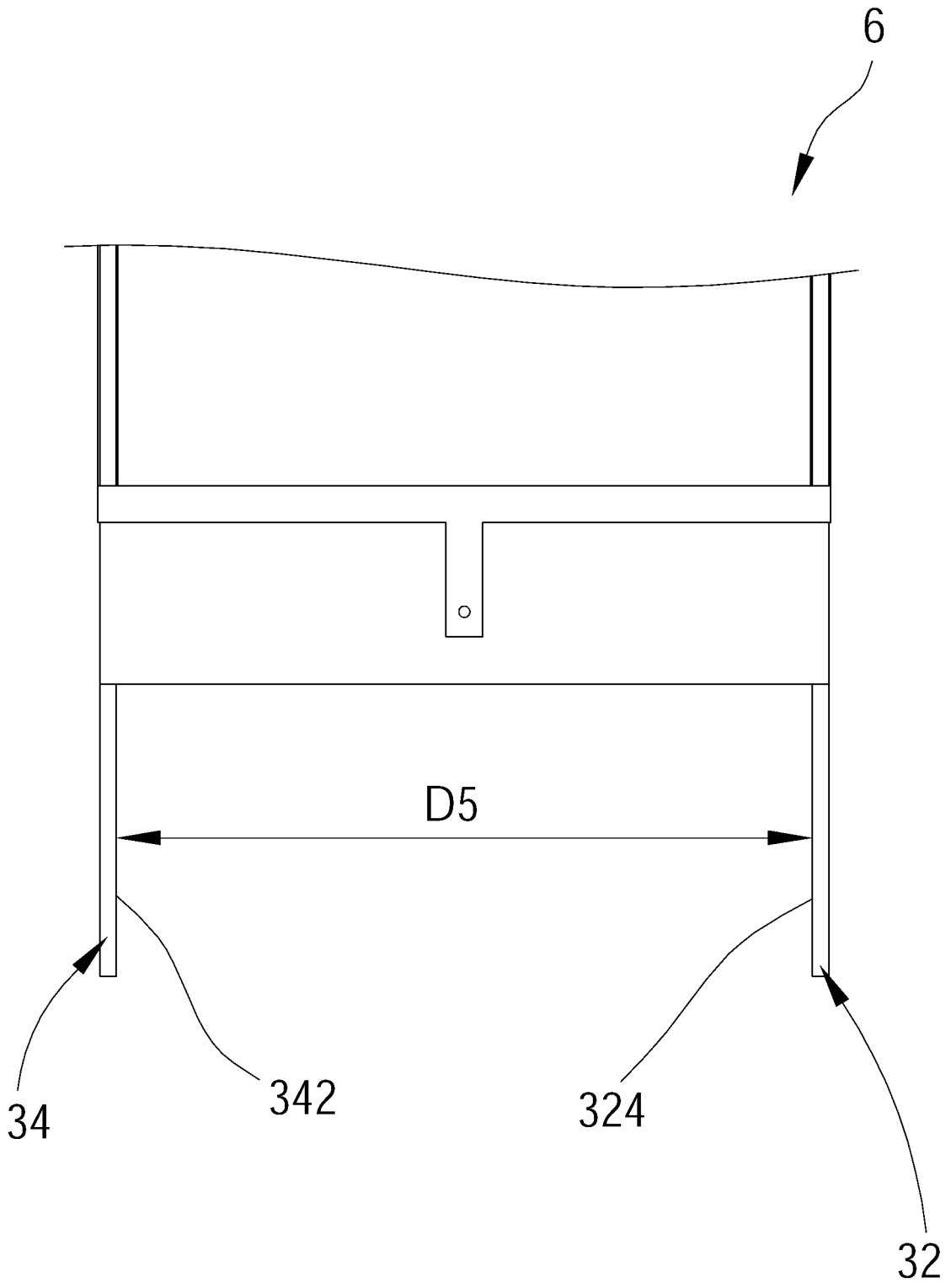
FIG. 15 is a top view of the microstrip collinear array according to a sixth embodiment of the present disclosure.

A microstrip collinear array 6 according to a sixth embodiment of the present disclosure is illustrated in FIG. 15, and has almost the same structures as that of the fourth embodiment, except that the gap D5 between the second surface 324 of the first bearing plate 32 and the third surface 342 of the second bearing plate 34 is 22.5 mm.

With the aforementioned design, by juxtaposing the two first antenna assemblies and the two second antenna assemblies, the microstrip collinear array of the present disclosure could achieve high peak gain. Compared to a single antenna assembly, which has to increase the number and the length of the planar antennas to achieve high peak gain, the microstrip collinear array of the present disclosure could effectively reduce the overall length and be adapted for miniaturization access point.

It must be pointed out that the embodiments described above are only some embodiments of the present disclosure. All equivalent structures which employ the concepts disclosed in this specification and the appended claims should fall within the scope of the present disclosure.

What is claimed is:

1. A microstrip collinear array, comprising:

a bearing member having a first end and a second end opposite to the first end in a first axial direction;

two first antenna assemblies juxtaposed on the bearing member, wherein each of the first antenna assemblies comprises a plurality of first planar antennas, a plurality of first transmission lines, and a first extending line; the first planar antennas of each of the first antenna assemblies are arranged at intervals in the first axial direction; two ends of each of the first transmission lines of each of the first antenna assemblies are respectively connected to the two adjacent first planar antennas; the first extending line of each of the first antenna assemblies is connected to one of the first planar antennas closest to the first end;

two second antenna assemblies juxtaposed on the bearing member and respectively located on a surface of the bearing member opposite to the first antenna assemblies, wherein each of the second antenna assemblies comprises a plurality of second planar antennas, a plurality of second transmission lines, and a second extending line; the second planar antennas of each of the second antenna assemblies are arranged at intervals in the first axial direction; two ends of each of the second transmission lines of each of the second antenna assemblies are respectively connected to the two adjacent second planar antennas; the second extending line of each of the second antenna assemblies is connected to one of the second planar antennas closest to the second end;

a first connecting line disposed on the bearing member, wherein the first connecting line comprises a first connecting section and a first driving section; the first connecting section extends in a second axial direction and is electrically connected to the first antenna assemblies; and a second connecting line disposed on the bearing member and located on a side of the bearing member opposite to the first connecting line; the second connecting line is electrically connected to the first connecting line and comprises a second connecting section and a second driving section; the second connecting section extends in the second axial direction and is electrically connected to the second antenna assemblies.

2. The microstrip collinear array of claim 1, wherein the first planar antennas of each of the first antenna assemblies and the corresponding second planar antennas of one of the second antenna assemblies are arranged in a staggered manner in the first axial direction.

3. The microstrip collinear array of claim 1, wherein the first connecting line overlaps with the second connecting line in a third axial direction perpendicular to the first axial direction and the second axial direction; the first driving section is electrically connected to the second driving section via a conductive hole on the bearing member.

4. The microstrip collinear array of claim 1, wherein each of the first planar antennas and each of the second planar antennas have a first length in the first axial direction and have a first width in the second axial direction; the first length is 12.5 mm; the first width is 14 mm; the first planar antennas of one of the first antenna assemblies are spaced from the first planar antennas of the other first antenna assembly by a first distance in the second axial direction; the first distance is at least 6.5 mm; the second planar antennas of one of the second antenna assemblies are spaced from the second planar antennas of the other second antenna assembly by a second distance in the second axial direction; the second distance is at least 6.5 mm.

5. The microstrip collinear array of claim 4, wherein each of the first transmission lines and each of the second transmission lines have a second length in the first axial direction; the second length is 14.5 mm; the first transmission lines of one of the first antenna assemblies are spaced from the first transmission lines of the other first antenna assembly by a third distance in the second axial direction; the third distance is at least 17.4 mm; the second transmission lines of one of the second antenna assemblies are spaced from the second transmission lines of the other second antenna assembly by a fourth distance in the second axial direction; the fourth distance is at least 17.4 mm; the first extending line of each of the first antenna assemblies and the second extending line of each of the second antenna assemblies have a third length in the first axial direction; the third length is 8.55 mm; each of the first transmission lines, each of the second transmission lines, the first extending line of each of the first antenna assemblies, and the second extending line of each of the second antenna assemblies have a second width in the second axial direction; the second width is 2.9-3.1 mm.

6. The microstrip collinear array of claim 1, wherein the first driving section comprises a first segment and a second segment; the first segment and the second segment extend in the first axial direction; the second segment is connected between the first segment and the first connecting section; a width of the first segment is smaller than a width of the second segment in the second axial direction; the second driving section comprises a third segment and a fourth segment; the third segment and the fourth segment extend in the first axial direction; the fourth segment is connected between the third segment and the second connecting section; a width of the third segment is smaller than a width of the fourth segment in the second axial direction.

7. The microstrip collinear array of claim 1, wherein the bearing member comprises a first bearing plate, a second bearing plate, and a connecting plate; the first bearing plate has a first surface and a second surface opposite to the first surface; the second bearing plate has a third surface and a fourth surface opposite to the third surface; the connecting plate is connected between a lateral edge of the first bearing plate and a lateral edge of the second bearing plate and has a fifth surface and a sixth surface opposite to the fifth surface; one of the first antenna assemblies is located on the first surface of the first bearing plate, and the other first antenna assembly is located on the fourth surface of the second bearing plate; one of the second antenna assemblies is located on the second surface of the first bearing plate, and the other second antenna assembly is located on the third surface of the second bearing plate; the first connecting line is located on the fifth surface of the connecting plate, and the second connecting line is located on the sixth surface of the connecting plate; the first connecting line overlaps with the second connecting line in a third axial direction perpendicular to the first axial direction and the second axial direction; the first driving section is electrically connected to the second driving section via a conductive hole on the connecting plate.

8. The microstrip collinear array of claim 7, wherein the first planar antennas on the first bearing plate and the second planar antennas on the first bearing plate are arranged in a staggered manner in the first axial direction; the first planar antennas on the second bearing plate and the second planar antennas on the second bearing plate are arranged in a staggered manner in the first axial direction.

9. The microstrip collinear array of claim 7, wherein each of the first planar antennas and each of the second planar antennas have a first length in the first axial direction and have a first width in the third axial direction; the first length is 13.8 mm; the first width is 16 mm; the second surface is spaced from the third surface by a gap; the gap is at least 6.5 mm.

10. The microstrip collinear array of claim 9, wherein each of the first transmission lines has a second length on the first axial direction; the second length is 15.8 mm; the first extending line of each of the first antenna assemblies and the second extending line of each of the second antenna assemblies have a third length in the first axial direction; the third length is 8.55 mm; each of the first transmission lines, each of the second transmission lines, the first extending line of each of the first antenna assemblies and the second extending line of each of the second antenna assemblies have a second width in the third axial direction; the second width is 2.9-3.1 mm.

11. The microstrip collinear array of claim 7, wherein the first extending line on the first bearing plate is electrically connected to the first connecting section; the first extending line on the second bearing plate is electrically connected to the first connecting section; one of the second planar antennas on the first bearing plate closest to the first end is electrically connected to the second connecting section; one of the second planar antennas on the second bearing plate closest to the first end is electrically connected to the second connecting section.

* * * * *